US010938152B2

(12) United States Patent
Brunet et al.

(10) Patent No.: US 10,938,152 B2
(45) Date of Patent: Mar. 2, 2021

(54) ELECTRICAL CONNECTOR ASSEMBLY

(71) Applicant: Connecteurs Electriques Deutsch, Evreux (FR)

(72) Inventors: Martin Brunet, Sainte-Colombe-pres-Vernon (FR); Thierry Cassar, Angerville la Campagne (FR); Jean-Luc Alibert, La Madeleine-de-Nonancourt (FR); Sylvain Le Gourrier, Burey (FR)

(73) Assignee: Connecteurs Electriques Deutsch, Evreux (FR)

( * ) Notice: Subject to any disclaimer, the term of this patent is extended or adjusted under 35 U.S.C. 154(b) by 0 days.

(21) Appl. No.: 16/277,232

(22) Filed: Feb. 15, 2019

(65) Prior Publication Data

US 2019/0260157 A1 Aug. 22, 2019

(30) Foreign Application Priority Data

Feb. 16, 2018 (EP) ..... 18305163

(51) Int. Cl.

| | |
|---|---|
| ***H01R 13/622*** | (2006.01) |
| ***H01R 13/426*** | (2006.01) |
| ***H01R 13/639*** | (2006.01) |
| *H01R 13/533* | (2006.01) |

(52) U.S. Cl.

CPC ..... *H01R 13/622* (2013.01); *H01R 13/426* (2013.01); *H01R 13/639* (2013.01); *H01R 13/533* (2013.01)

(58) Field of Classification Search

CPC .. H01R 13/622; H01R 13/426; H01R 13/639; H01R 13/533

USPC ..... 439/312

See application file for complete search history.

(56) References Cited

U.S. PATENT DOCUMENTS

| | | | | |
|---|---|---|---|---|
| 4,588,245 | A * | 5/1986 | Schwartz | H01R 13/622 439/312 |
| 4,648,670 | A * | 3/1987 | Punako | H01R 13/622 285/319 |
| 5,088,013 | A * | 2/1992 | Revis | F21V 21/092 200/61.59 |
| 6,152,753 | A | 11/2000 | Johnson et al. | |
| 9,531,120 | B2 * | 12/2016 | Bates, III | H01R 13/622 |
| 9,666,973 | B1 | 5/2017 | Strahl | |

(Continued)

FOREIGN PATENT DOCUMENTS

| | | |
|---|---|---|
| EP | 0039640 B1 | 8/1984 |
| EP | 2993739 A1 | 3/2016 |
| FR | 2606940 A1 | 5/1988 |

OTHER PUBLICATIONS

Extended European Search Report, Application No. 18305163.0, dated Jul. 17, 2018, 7 pages.

*Primary Examiner* — Jean F Duverne
(74) *Attorney, Agent, or Firm* — Barley Snyder

(57) ABSTRACT

An electrical connector assembly comprises a connector shell configured to interface with a mating connector shell, a coupling member configured to receive the connector shell and having an internal thread engaging the mating connector shell, and a retaining member configured to retain the connector shell in the coupling member. The connector shell has a plurality of ratchet teeth and defines a longitudinal axis. The plurality of ratchet teeth form a first ratchet ring and a second ratchet ring around the connector shell.

23 Claims, 4 Drawing Sheets

(56) References Cited

U.S. PATENT DOCUMENTS

| | | | | |
|---|---|---|---|---|
| 2009/0134730 | A1* | 5/2009 | Kurokawa | H02K 3/47<br>310/156.37 |
| 2013/0244466 | A1* | 9/2013 | Cole | H01R 13/533<br>439/312 |
| 2016/0020552 | A1* | 1/2016 | Strahl | H01R 13/622<br>439/321 |
| 2018/0034183 | A1* | 2/2018 | Myong | H01R 13/426 |

* cited by examiner

ELECTRICAL CONNECTOR ASSEMBLY

CROSS-REFERENCE TO RELATED APPLICATION

This application claims the benefit of the filing date under 35 U.S.C. § 119(a)-(d) of European Patent Application No. 18305163.0 filed on Feb. 16, 2018.

FIELD OF THE INVENTION

The present invention relates to an electrical connector and, more particularly, to a circular electrical connector having an anti-decoupling mechanism.

BACKGROUND

Circular connectors are found in various types of coupling devices, such as a fine pitch threaded coupling or a triple start threaded coupling for quick connections. When used in harsh environments, for instance environments in which a connector is submitted to vibrations, high temperatures, or even fire, circular connectors require a dedicated anti-decoupling mechanism, which typically comprises a ratchet mechanism, to prevent a possible decoupling between the two mating connector shells.

Circular connectors with anti-decoupling mechanisms are disclosed in EP 0039640 B1, EP 2993739 A1, and U.S. Pat. No. 9,666,973 B1, which disclose, in particular, electrical connector assemblies in which a coupling ring cooperates with a first connector shell by a ratchet mechanism and is secured thereto by a retaining ring. The coupling ring then threadably engages a second connector shell to be connected to the first connector shell. In these connector assemblies, the first connector shell, or circular connector body, comprises ratchet teeth forming a single external ratchet ring or knurling.

In some harsh environments requiring particularly resistant connectors, circular connectors may use metallic connector shells, and the coupling achieves a metal/metal contact or bottoming between the two mating connector shells. In these environments, anti-decoupling mechanisms are an even more important component. In a quick threaded coupling, a small angular displacement of the coupling ring causes an important axial displacement of the connected elements, which can induce electrical discontinuities and even fretting corrosion. Thus, additional parts, such as springs and/or anti-fire devices, are usually required in addition to the ratchet mechanism to resist and/or control the rotation of the coupling ring and ensure a proper metal/metal bottoming between the two mating connector shells.

In EP 0039640 B1, two gull-shaped leaf springs are mounted by a pin within a respective undercut portion of the coupling ring. Each wing of a gull-shaped leaf spring has a medial dimple which engages a gear tooth of the connector shell.

In EP 2993739 A1, six spring members are positioned around the inner perimeter of an annular insert or retaining ring and are integrally formed with the annular insert. A space or gap is defined between each integrally formed spring member and a portion of the body of the annular insert to allow deflection of the spring members. Furthermore, each integrally formed spring member has an associated tooth or catch for engaging a track of grooves on the outer perimeter of the connector shell.

In U.S. Pat. No. 9,666,973 B1, a coupling comprises a connector body, an inner sleeve that receives the connector body, an outer sleeve that surrounds the inner sleeve, and a retaining ring. Two spring members are attached to an inner surface of the outer sleeve and bias a respective pawl against the ratchet teeth of the connector body.

The addition of elements such as springs and/or anti-fire devices, however, increases the complexity of the connector assemblies, as well as their assembly time and manufacturing costs. Furthermore, known connector assemblies are not always reliable in harsh environments, especially during vibrations, in high temperatures, or during fire tests.

SUMMARY

An electrical connector assembly comprises a connector shell configured to interface with a mating connector shell, a coupling member configured to receive the connector shell and having an internal thread engaging the mating connector shell, and a retaining member configured to retain the connector shell in the coupling member. The connector shell has a plurality of ratchet teeth and defines a longitudinal axis. The plurality of ratchet teeth form a first ratchet ring and a second ratchet ring around the connector shell.

BRIEF DESCRIPTION OF THE DRAWINGS

The invention will now be described by way of example with reference to the accompanying Figures, of which.

DETAILED DESCRIPTION OF THE EMBODIMENT(S)

Exemplary embodiments of an electrical connector assembly according to the present invention will now be described with reference to FIGS. 1-6. The features illustrated or described with reference to a particular exemplary embodiment may be combined with the features of other embodiments to form further embodiments of the present invention.

Figure 1:
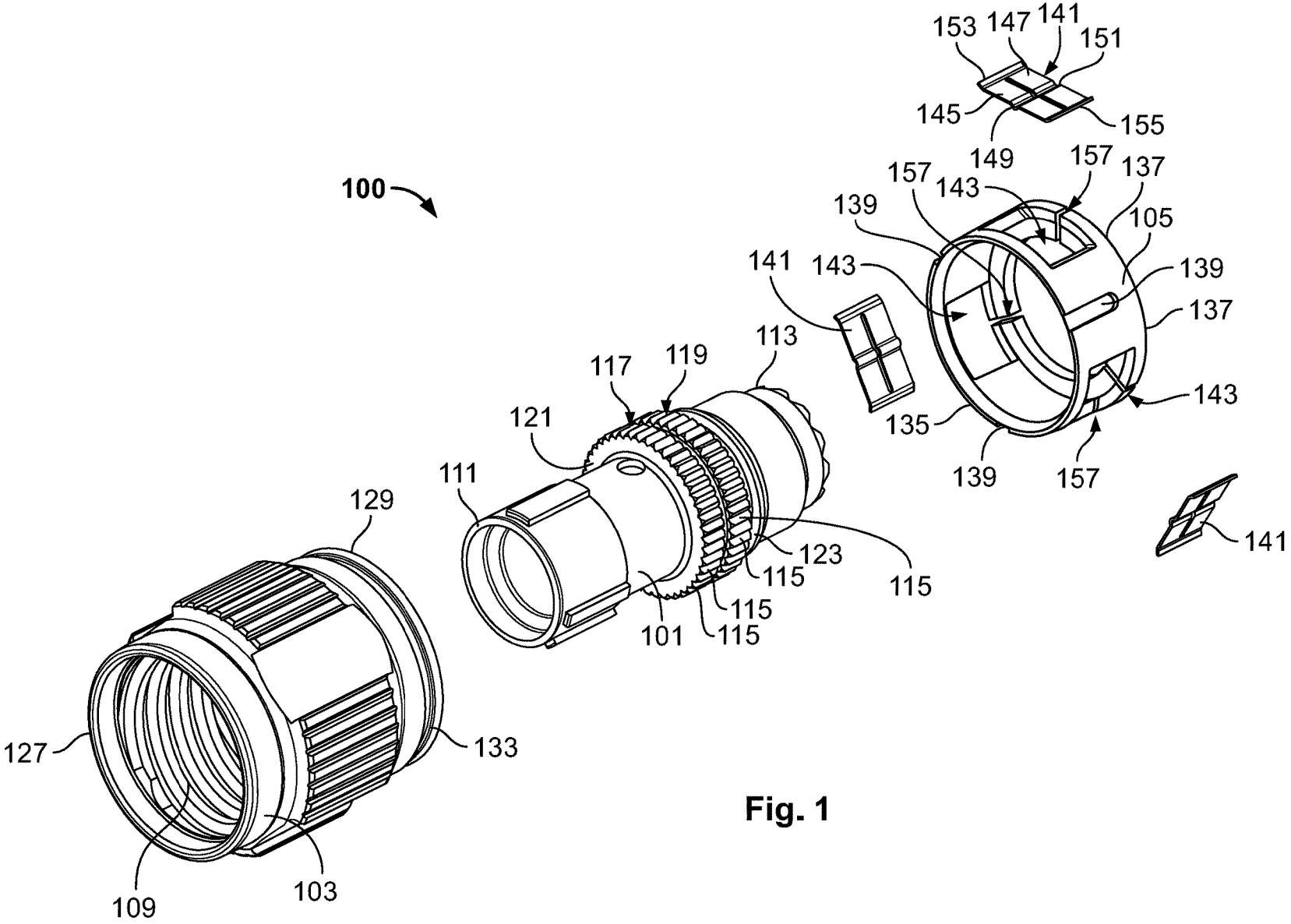
FIG. 1 is an exploded perspective view of an electrical connector assembly according to an embodiment.

An electrical connector assembly 100 according to an embodiment is shown in FIG. 1. The electrical connector assembly 100 comprises a connector shell 101 configured to be coupled to a mating connector shell and secured thereto by an anti-decoupling mechanism, as will be described more in detail hereafter. The electrical connector assembly 100 comprises a coupling member 103 and a retaining member 105 to form the anti-decoupling mechanism together with the connector shell 101.

In various embodiments, the connector shell 101 could be configured to retain male or female contacts and, accordingly, could be referred to as a "plug" or as a "receptacle", respectively. In the shown embodiments, the connector shell 101 is a plug. As shown in FIG. 1, the connector shell 101 can be a circular connector body, and the coupling member 103 and retaining member 105 can, therefore, both be ring-shaped. The connector shell 101 defines a longitudinal axis 107, shown in FIG. 2, which corresponds essentially to a coupling axis of the electrical connector assembly 100 and a mating connector shell. Thus, "proximal" and "distal" end portions of the various components of the electrical connector assembly 100 extending along the longitudinal axis 107 can be defined as being portions thereof configured to be proximal or distal with respect to, i.e. facing towards or away from, a mating connector shell to be coupled to the connector shell 101, as shown in FIGS. 2 and 6.

Figure 2:
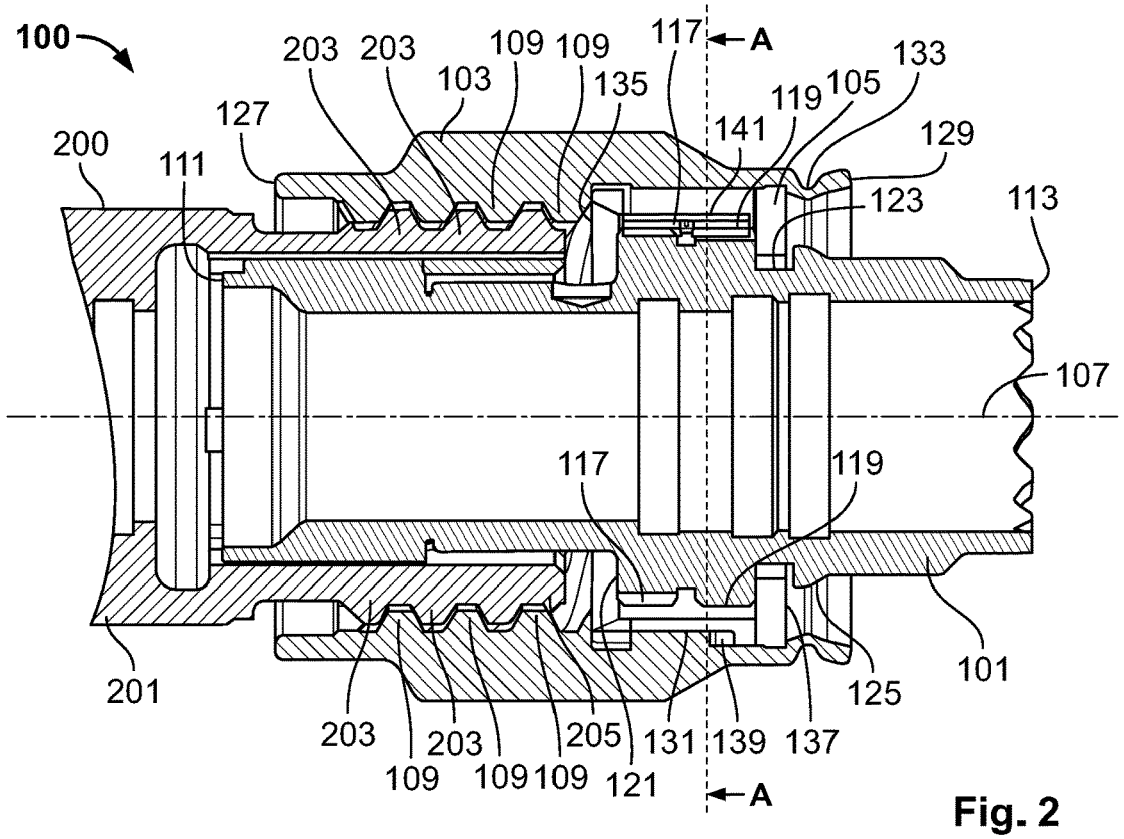
FIG. 2 is a sectional side view of the electrical connector assembly coupled to a mating connector shell.
Figure 3:
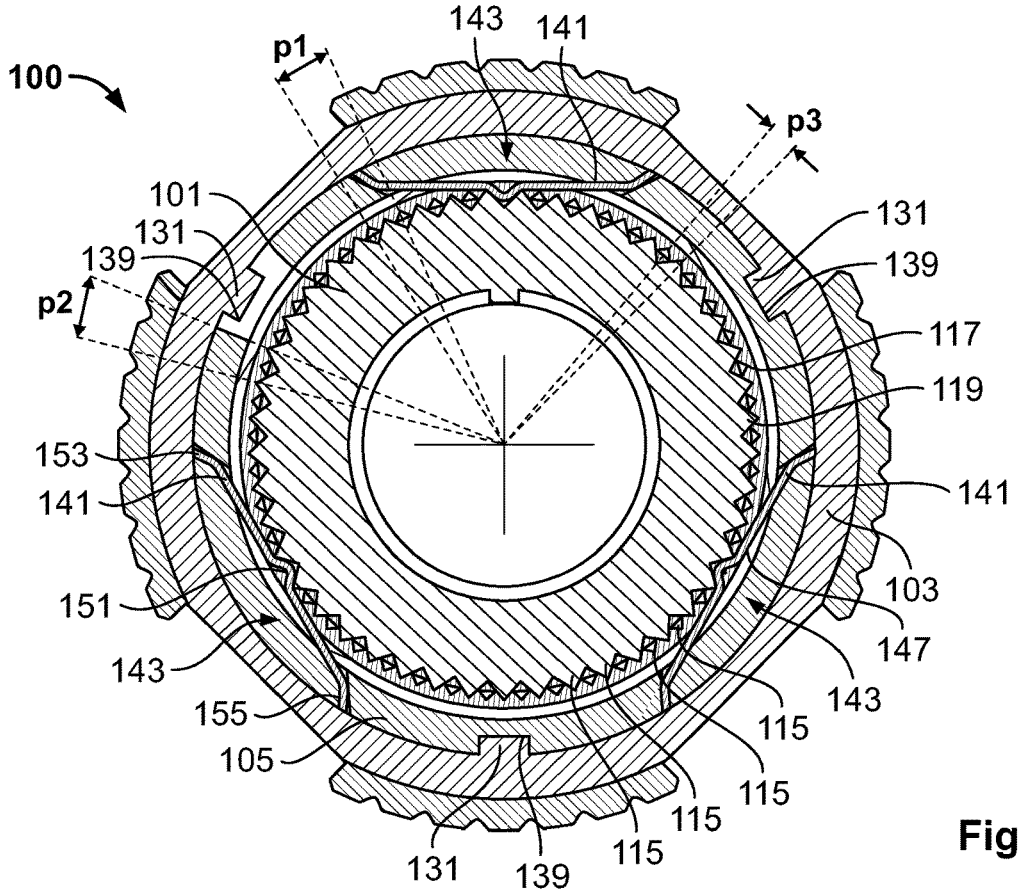
FIG. 3 is a sectional end view of the electrical connector assembly coupled to the mating connector shell, taken along line A-A of FIG. 2.

The coupling member 103 is configured to receive the connector shell 101, as shown in FIGS. 1-3. The coupling member 103 has internal threads 109 threadably engaging a mating connector shell to be interfaced, i.e. coupled, to the connector shell 101 as shown in FIGS. 2 and 6. The retaining member 105 is configured to maintain the electrical connector assembly 100 when assembled; to retain the connector shell 101 and the coupling member 103 as will be explained more in detail hereafter. In the embodiments shown in FIGS. 1-3, 5, and 6, the coupling member 103 and the retaining member 105 are both configured to be rotatably arranged about the connector shell 101, in particular in a coaxial manner, with the retaining member 105 being disposed between the connector shell 101 and the coupling member 103.

As shown in FIGS. 1, 2, 5, and 6, the connector shell 101 extends substantially along the longitudinal or coupling axis 107, between a proximal end section 111 and a distal end section 113. A ratchet mechanism is used as an anti-decoupling mechanism of the electrical connector assembly 100. The connector shell 101 has external ratchet teeth 115. The ratchet teeth 115 form first (or proximal) and second (or distal) ratchet rings 117, 119. The connector shell 101 comprises dual ratchet rings 117, 119 that may also be referred to as a double knurling ratchet system 117, 119. The resistance and control of the anti-decoupling mechanism can thus be improved with respect to known circular connector systems using single knurling ratchet systems.

Figure 6:
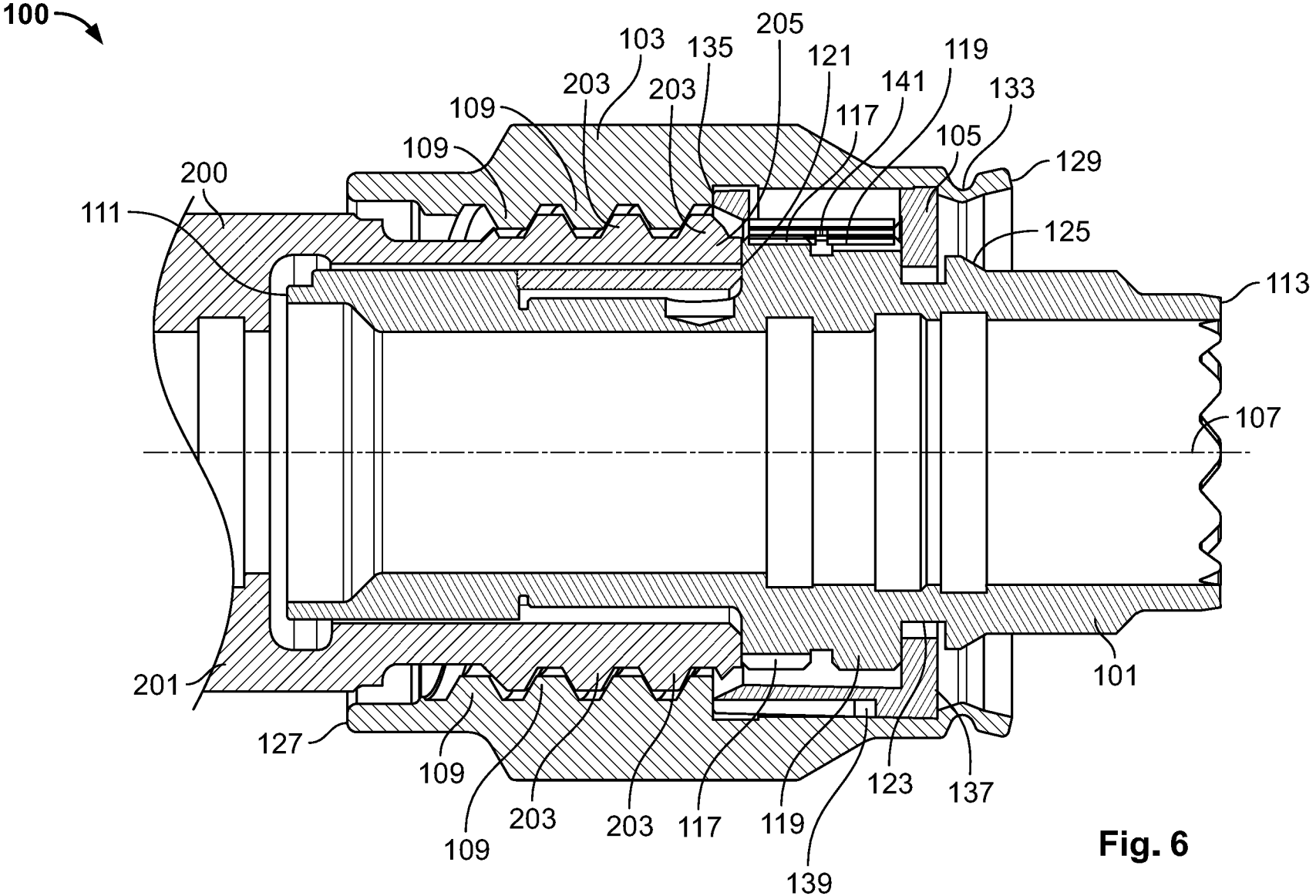
FIG. 6 is a sectional side view of the electrical connector assembly secured to the mating connector shell.

As shown in FIGS. 1, 2, and 6, the connector shell 101 has a coupling section 121 defined by the first or proximal ratchet ring 117. When the electrical connector assembly 100 is correctly mated to a mating connector and retained by the anti-decoupling mechanism, a bottoming is achieved between the proximal end section 111 and a corresponding section of the mating connector, and between the coupling section 121 and a corresponding section of the mating connector.

The connector shell 101 has a groove 123, an annular groove 123 in an embodiment, on an outer perimeter thereof. As shown in FIGS. 1, 2, 4, and 6, the annular groove 123 is provided towards a distal portion of the connector shell 101, i.e. in direction of the distal end section 113 after or behind the second ratchet ring 119. In some embodiments, a distal portion of the connector shell 101 towards the annular groove 123 can be a slanted portion 125.

In an embodiment as shown in FIG. 3, the first and second ratchet rings 117, 119 can be offset angularly with respect to each other. Thus, it is possible to reduce the overall angular or circular pitch of the ratchet system, i.e. the distance between successive ratchet teeth 115, by a predetermined amount with respect to known circular connectors using single knurling ratchet systems. In known circular connectors, a pitch reduction requires manufacturing a smaller single ratchet ring, which becomes difficult for circular connectors of small sizes and/or diameters. The present invention allow reducing the angular circular pitch of the ratchet system by using an offset double knurling ratchet system. This also reduces any longitudinal displacement of the connector shell 101 with respect to a mating connector shell upon rotation of the coupling member 103.

In some embodiments, the angular or circular pitch p1 shown in FIG. 3, the distance between successive ratchet teeth 115 of the first or proximal ratchet ring 117, can be the same as the angular or circular pitch p2, the distance between successive ratchet teeth 115 of the second or distal ratchet ring 119. In other embodiments, the pitch p1 could be different from the pitch p2. In some embodiments, both ratchet rings 117, 119 could also be offset angularly by half a step with respect to each other, and the overall angular or circular pitch p3, the distance between a ratchet tooth 115 of the first ratchet ring 117 and an immediately adjacent ratchet tooth 115 of the second ratchet ring 119, could be half of the angular or circular pitch p1 (or p2) of a given ratchet ring 117, 119. In other words, when both ratchet rings 117, 119 have the same angular or circular pitch, a half step asynchronization with $p3=p1/2=p2/2$ is achieved between both ratchet rings 117, 119.

The coupling member 103, as shown in FIGS. 1-3 and 6, is essentially ring-shaped and is configured to be mounted coaxially onto the connector shell 101 and retaining member 105. The coupling member 103 extends substantially along the longitudinal or coupling axis 107, between a proximal end section 127 and a distal end section 129.

An internal proximal portion of the coupling member 103 is configured for engaging a mating connector shell and, accordingly, comprises internal threads 109 for threadably engaging the mating connector shell. An internal distal portion of the coupling member 103 is configured for receiving and cooperating with the retaining member 105 mounted onto the connector shell 101. In some embodiments, the coupling member 103 has one or more internal ribs 131 arranged and configured to cooperate with corresponding grooves of the retaining member 105, for instance grooves 139. In some embodiments, the internal ribs 131 can extend longitudinally along the inner surface of the coupling member 103. Furthermore, in some embodiments, when the coupling member 103 has more than one internal rib 131, the internal ribs 131 can be arranged evenly along the internal circumference of the coupling member 103. In the embodiments shown in FIG. 3, the coupling member 103 has three internal ribs 131 which are spaced apart evenly along a circumference of the coupling member 103.

The coupling member 103 can also comprise, towards a distal end section 129, a deformation or swaging 133 forming an internal shoulder at an inner circumference of the coupling member 103, as shown in FIGS. 1, 2, and 6. The swaging 133 can create an abutment with the retaining member 105, in particular with a distal end section 137 thereof, as shown in FIGS. 2 and 6, which improves the anti-decoupling system and the proper bottoming of the connector shell 101 with a mating connector shell.

As shown in FIG. 1, the retaining member 105 can be essentially ring-shaped and is configured to be mounted coaxially between the connector shell 101 and the coupling member 103. The retaining member 105 also extends substantially along the longitudinal or coupling axis 107, between a proximal end section 135 and a distal end section 137.

The retaining member 105 is configured and arranged for cooperating with the connector shell 101 and, in particular, with the coupling member 103 to provide the anti-decoupling mechanism. In respect of the coupling member 103, in the embodiment shown in FIGS. 2, 3, 5, and 6, this can be achieved by providing one or more grooves 139 arranged and configured to cooperate, for instance, with the one or more internal ribs 131 of the coupling member 103, respectively. In some embodiments, the grooves 139 can extend longitudinally from the proximal end section 135 and along the outer surface of the retaining member 105. Furthermore, in some embodiments, the number of grooves 139 of the retaining member 105 can be the same as the number of internal ribs 131 of the coupling member 103, and the grooves 139 can, therefore, also be arranged evenly on a circumference of the retaining member 105. In the embodiment shown in FIG. 3, three internal ribs 131 of the coupling member 103 cooperate with respective grooves 139 of the retaining member 105.

One or more spring members 141, as shown in FIGS. 1-3, can be provided on the retaining member 105, and can be arranged and configured to engage both ratchet rings 117, 119. The spring members 141 can be arranged and configured to engage both ratchet rings 117, 119 simultaneously, providing a double knurling ratchet system with increased resistance and better control of the rotation of the coupling member 103.

Figure 4:
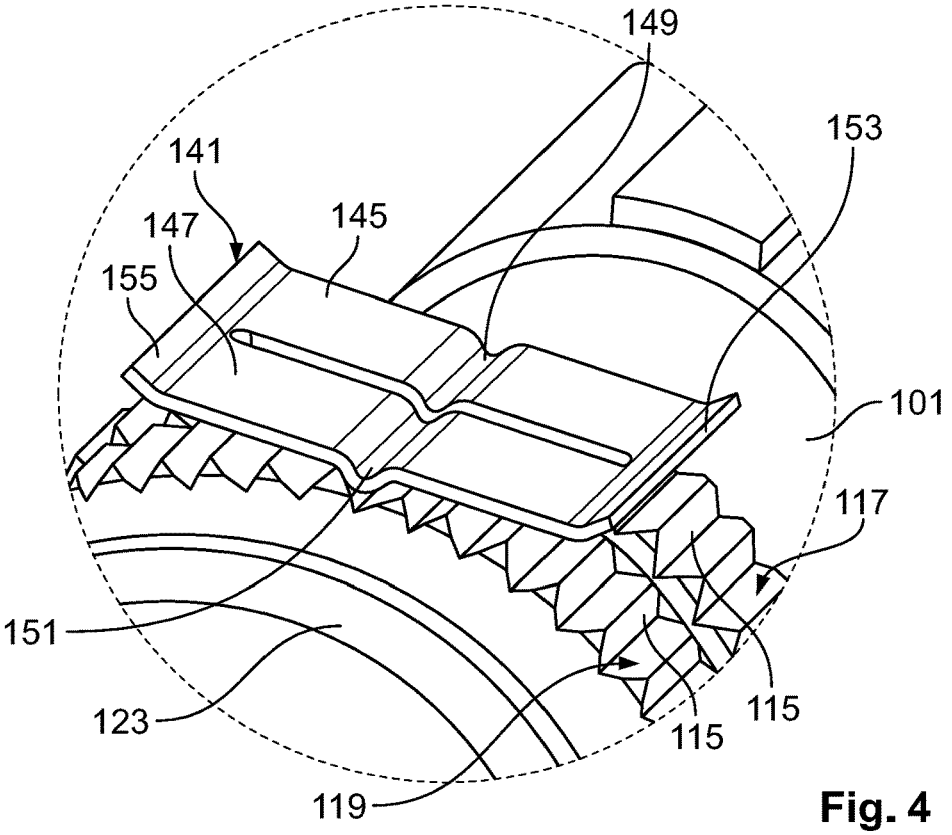
FIG. 4 is a perspective view of a spring member with first and second ratchet rings of a connector shell of the electrical connector assembly.

In the embodiments shown in FIGS. 1 and 3, the electrical connector assembly 100 can comprise more than one spring member 141. The various spring members 141 can be arranged evenly along a circumference of the retaining member 105. In the shown embodiments, three spring members 141 are provided and are arranged in respective spring member receiving openings 143 of the retaining member 105. As shown in FIGS. 3 and 4, the spring members 141 and the spring member receiving openings 143 could be arranged such that the spring members 141 are disposed in a substantially tangential manner with respect to both ratchet rings 117, 119.

The spring members 141 are arranged and configured to engage one of the ratchet rings 117, 119 between two successive ratchet teeth 115, while simultaneously engaging the other one of the ratchet rings 117, 119 at the top of a ratchet tooth 115. As shown in the embodiments of FIGS. 3 and 4, a spring member 141 engages the second or distal ratchet ring 119 in the space or "valley" between two successive ratchet teeth 115. Due to the half step asynchronization between both ratchet rings 117, 119, the spring member 141 simultaneously engages the first or proximal ratchet ring 117 at the top of a ratchet teeth 115. Thus, a rotation of the coupling member 103 will automatically encounter a biasing force due to the one or more spring members 141. In an environment subject to vibrations, this will ensure that the coupling member 103 is essentially automatically biased towards the previous or the subsequent click, thereby preventing or at least effectively controlling a displacement of the components along the longitudinal axis 107.

As shown in FIGS. 1 and 4, the spring member 141 has two substantially independent blades 145, 147. A first or proximal blade 145 is arranged and configured to engage the first or proximal ratchet ring 117 and a second or distal blade 147 is arranged and configured to engage the second or distal ratchet ring 119. Thus, a rotation of the coupling member 103 will automatically encounter a biasing force, as at least one of the two blades 145, 147 will always be biased towards engaging a respective ratchet ring 117, 119 in the space or "valley" between two successive ratchet teeth 115.

Each blade 145, 147 of a spring member 141, as shown in FIGS. 3 and 4, has a respective protrusion 149, 151 arranged and configured to engage a respective ratchet ring 117, 119. The first or proximal blade 145 has a first or proximal protrusion 149, and the second or distal blade 147 has a second or distal protrusion 151. Because there is a half step asynchronization between both ratchet rings 117, 119, both protrusions 149, 151 can be arranged one behind the other in the longitudinal direction. Thus, when the second or distal protrusion 151 engages the space or "valley" between two successive ratchet teeth 115 of the second or distal ratchet ring 119, the first or proximal protrusion 149 engages the top of a ratchet tooth 115 of the first or proximal ratchet ring 117. Conversely, when the first or proximal protrusion 149 engages the space or "valley" between two successive ratchet teeth 115 of the first or proximal ratchet ring 117, the second or distal protrusion 151 will be on top of a ratchet tooth 115 of the second or distal ratchet ring 119. A rotation of the coupling member 103 disengaging the first and second protrusions 149, 151 from these positions will encounter a biasing force that will tend to return the coupling member 103 to a previous or a subsequent click. Thus, the resistance and control of the rotation of the coupling member 103 will be improved significantly in comparison with known circular connector systems using only a single knurling ratchet system.

In some embodiments, the first and second blades 145, 147 of a spring member 141 could be fully independent, i.e. a spring member 141 could, in fact, be split into two "single blade" spring members arranged one behind the other in the longitudinal direction, wherein a "single blade" spring member engages the first or proximal ratchet ring 117, while the other "single blade" spring member engages the second or distal ratchet ring 119. As shown in the embodiments of FIGS. 1 and 4, the first and second blades 145, 147 of a spring member 141 can be joined at their extremities and, therefore, have common supporting portions 153, 155 for supporting the spring member 141 in the spring member receiving opening 143 of the retaining member 105. Furthermore, although the first and second protrusions 149, 151 of the spring member 141 are illustrated as being essentially U or V-shaped recesses in FIG. 4, in other embodiments, the protrusions 149, 151 could be provided in the form of ribs, pins, teeth, catches, or the like, or even a combination thereof.

Figure 5:
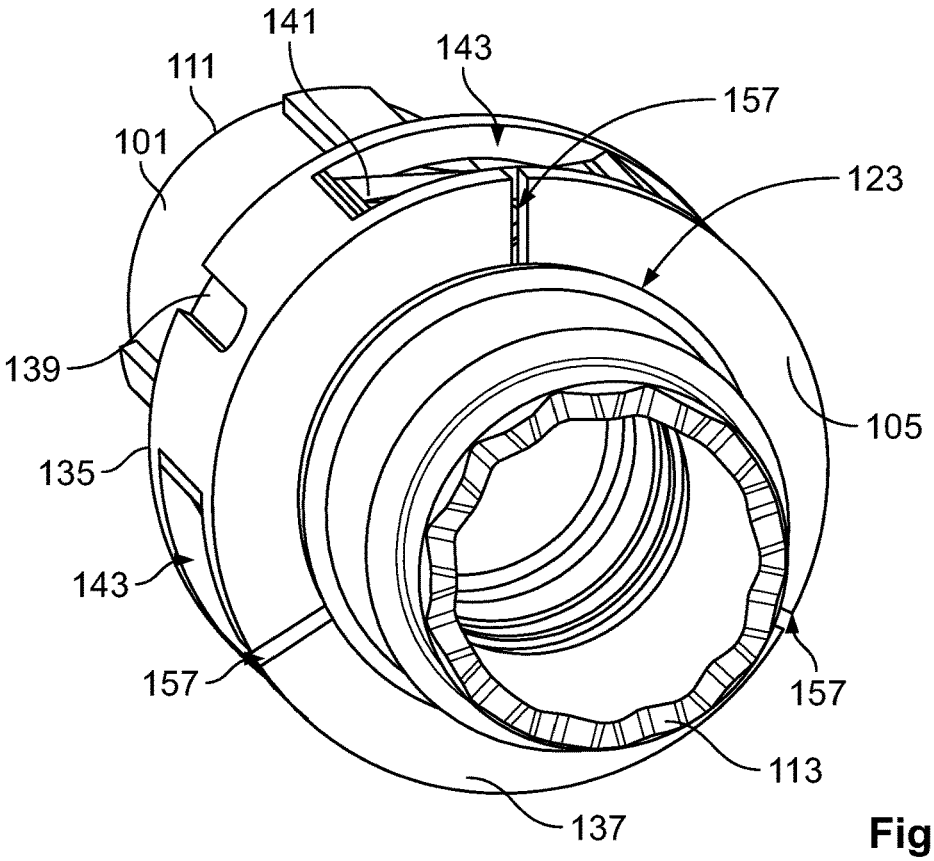
FIG. 5 is a perspective view of a retaining member of the electrical connector assembly on the connector shell.

In order to facilitate mounting of the retaining member 105 on the connector shell 101, and of the coupling member 103, the retaining member 105 has one or more slots 157. As shown in FIGS. 1 and 5, the slots 157 can be cuts in the distal end section 137 of the retaining member 105. In some embodiments, the slots 157 can even extend into a respective one of the one or more spring member receiving openings 143. The slots 157 at the distal end section 137 of the retaining member 105 facilitate mounting of the retaining member 105 on the connector shell 101. The slots 157 allow the resilient deformation of the distal end section 137 of the retaining member 105 in order to overcome the slanted portion 125 of the connector shell 101, after which the distal end section 137 can be clipped with the annular groove 123.

When mounting the coupling ring 103, the passage of the internal shoulder formed by the swaging 133 will cause the distal end section 137 of the retaining member 105 to be resiliently biased in the annular groove 123, which is also facilitated by the slots 157. When the electrical connector assembly 100 is assembled, i.e. when the coupling ring 103 is mounted onto the connector shell 101 with the retaining ring 105 as shown in FIGS. 2 and 6, the internal shoulder formed by the swaging 133 comes into abutment with the distal end section 137 of the retaining ring 105.

The mating or coupling sequence of the electrical connector assembly 100 and a mating connector 200 will now be described with reference to FIGS. 2 and 6. Because the connector shell 101 of the electrical connector assembly 100 is a plug in the shown embodiments, the mating connector shell 201 of the mating connector 200 is a receptacle. In the shown embodiments, the mating connector shell 201 can be a circular receptacle body. In other embodiments, however, the plug and receptacle could be switched without departing from the scope of the present invention.

FIG. 2 shows an exemplary state in which the mating connector 200 approaches the electrical connector assembly 100 and is being engaged therewith. The mating connector shell 201 of the mating connector 200 can comprise, at an end portion thereof, external threads 203 which can threadably engage the internal threads 109 of the coupling member 103. In the state shown in FIG. 2, the mating connector shell 201 is not fully engaged with the coupling member 103; the external threads 203 of the mating connector shell 201 are not fully engaged with the internal threads 109 of the coupling member 103, and a bottoming between a coupling section 205 of the mating connector shell 201 and a corresponding coupling section 121 of the connector shell 101 is not yet achieved.

FIG. 6 shows another exemplary state in which the mating connector shell 201 is fully engaged with the coupling member 103; the external threats 203 of the mating connector shell 201 are fully engaged with the internal threads 109 of the coupling member, and a bottoming is achieved between the coupling section 205 of the mating connector shell 201 and the corresponding coupling section 121 of the connector shell 101.

In combination with the half step asynchronization of the first and second ratchet rings 117, 119, the spring members 141 provide even more control of the rotation of the coupling member 103 with respect to the connector shell 101. For instance, in environments subject to vibrations, the spring members 141 will always ensure that the coupling member 103 stays in place, or at least that the coupling member 103 is automatically biased towards the previous or the subsequent click. Because of the reduction in the angular or circular pitch, the electrical connector assembly 100 will effectively limit any relative displacements of the connector shell 101 with respect to a mating connector shell 201 along the longitudinal or coupling axis 107 upon rotation of the coupling member 103. This is achieved while also ensuring that the bottoming between the connector shell 101 and the mating connector shell 201 is maintained. In addition, the combined deformation of the swaging 133 and the retaining member 105, in particular in embodiments where the retaining member 105 comprises one or more slots 157, improves the anti-decoupling mechanism, as it ensures that the bottoming between the connector shell 101 and the mating connector shell 201 is maintained.

In environments requiring that the connector shell 101 and the mating connector shell 201 are made of a metal or metal alloy, a proper metal/metal bottoming can be achieved and effectively maintained, preventing the occurrence of fretting corrosion. Furthermore, by reducing the angular or circular pitch of the ratchet system, which results in reducing a possible displacement along the coupling axis 107, it is also possible to use a natural over-travel by deformation of components. In other words, it is possible to continue screwing the coupling member 103 while the metal/metal bottoming of the connector shell 101 and the mating connector shell 201 coupled thereto is already achieved.

The electrical connector assembly 100 is reliable during operations in harsh environments, especially in environments in which the electrical connector assembly is submitted to vibrations, high temperatures, and even fire. Furthermore, the electrical connector assembly 100 can be assembled in a simple and reliable manner, which decreases manufacturing costs, assembly complexity, and assembly time with respect to known electrical connector systems with anti-decoupling mechanisms.

What is claimed is:

1. An electrical connector assembly, comprising:

a connector shell configured to interface with a mating connector shell, the connector shell having a plurality of ratchet teeth and defining a longitudinal axis, the plurality of ratchet teeth forming a first ratchet ring and a second ratchet ring around the connector shell;

a coupling member configured to receive the connector shell and having an internal thread engaging the mating connector shell;

a retaining member configured to retain the connector shell in the coupling member; and a spring member disposed on the retaining member and configured to engage the first ratchet ring and the second ratchet ring, the spring member simultaneously engages between a pair of adjacent ratchet teeth of one of the first ratchet ring and the second ratchet ring and at a top of one of the ratchet teeth of the other of the first ratchet ring and the second ratchet ring.

2. The electrical connector assembly of claim 1, further comprising a plurality of spring members disposed evenly around a circumference of the retaining member.

3. The electrical connector assembly of claim 1, wherein the spring member is disposed tangential to the first ratchet ring and the second ratchet ring.

4. The electrical connector assembly of claim 1, wherein the spring member has a first blade and a second blade substantially independent from the first blade.

5. The electrical connector assembly of claim 4, wherein the first blade engages the first ratchet ring and the second blade engages the second ratchet ring.

6. The electrical connector assembly of claim 5, wherein the first blade has a first protrusion engaging the first ratchet ring and the second blade has a second protrusion engaging the second ratchet ring.

7. The electrical connector assembly of claim 1, wherein the retaining member has a spring member receiving opening receiving the spring member.

8. The electrical connector assembly of claim 7, wherein the retaining member has a slot at a distal end section of the retaining member.

9. The electrical connector assembly of claim 8, wherein the slot extends into the spring member receiving opening.

10. The electrical connector assembly of claim 1, wherein the connector shell has an annular groove disposed around a circumference of the connector shell and toward a distal end of the connector shell with respect to the first ratchet ring and the second ratchet ring.

11. The electrical connector assembly of claim 1, wherein the ratchet teeth of the first ratchet ring are offset circumferentially with respect to the ratchet teeth of the second ratchet ring.

12. The electrical connector assembly of claim 11, wherein the first ratchet ring and the second ratchet ring each have a same pitch between successive ratchet teeth.

13. The electrical connector assembly of claim 12, wherein the ratchet teeth of the first ratchet ring are circumferentially offset by a distance of half of the pitch from the ratchet teeth of the second ratchet ring.

14. The electrical connector assembly of claim 1, wherein the coupling member has a swaging disposed at a distal end of the coupling member and forming an internal shoulder along an internal circumference of the coupling member.

15. The electrical connector assembly of claim 1, wherein the retaining member has a groove arranged on an outer surface thereof cooperating with the coupling member.

16. The electrical connector assembly of claim 15, wherein the groove extends in a longitudinal direction from a proximal end section of the retaining member.

17. The electrical connector assembly of claim 16, wherein the coupling member has an internal rib disposed on an inner circumference of the coupling member and a distal portion of the coupling member.

18. The electrical connector assembly of claim 17, wherein the internal rib extends in the longitudinal direction and cooperates with the retaining member.

19. An electrical connector assembly, comprising:

a connector shell configured to interface with a mating connector shell, the connector shell having a plurality of ratchet teeth and defining a longitudinal axis, the plurality of ratchet teeth forming a first ratchet ring and a second ratchet ring around the connector shell, the ratchet teeth of the first ratchet ring are offset circumferentially with respect to the ratchet teeth of the second ratchet ring, the first ratchet ring and the second ratchet ring each have a same pitch between successive ratchet teeth;

a coupling member configured to receive the connector shell and having an internal thread engaging the mating connector shell; and a retaining member configured to retain the connector shell in the coupling member.

20. The electrical connector assembly of claim 19, wherein the ratchet teeth of the first ratchet ring are circumferentially offset by a distance of half of the pitch from the ratchet teeth of the second ratchet ring.

21. An electrical connector assembly, comprising:

a connector shell configured to interface with a mating connector shell, the connector shell having a plurality of ratchet teeth and defining a longitudinal axis, the plurality of ratchet teeth forming a first ratchet ring and a second ratchet ring around the connector shell;

a coupling member configured to receive the connector shell and having an internal thread engaging the mating connector shell, the coupling member has a swaging disposed at a distal end of the coupling member and forming an internal shoulder along an internal circumference of the coupling member; and a retaining member configured to retain the connector shell in the coupling member.

22. An electrical connector assembly, comprising:

a connector shell configured to interface with a mating connector shell, the connector shell having a plurality of ratchet teeth and defining a longitudinal axis, the plurality of ratchet teeth forming a first ratchet ring and a second ratchet ring around the connector shell;

a coupling member configured to receive the connector shell and having an internal thread engaging the mating connector shell, the coupling member has an internal rib disposed on an inner circumference of the coupling member and a distal portion of the coupling member; and a retaining member configured to retain the connector shell in the coupling member, the retaining member has a groove arranged on an outer surface thereof cooperating with the coupling member, the groove extends in a longitudinal direction from a proximal end section of the retaining member.

23. The electrical connector assembly of claim 22, wherein the internal rib extends in the longitudinal direction and cooperates with the retaining member.

* * * * *